US005206485A

United States Patent [19]

Srubas et al.

[11] Patent Number: 5,206,485

[45] Date of Patent: Apr. 27, 1993

[54] LOW ELECTROMAGNETIC AND ELECTROSTATIC FIELD RADIATING HEATER CABLE

[75] Inventors: Robert C. Srubas, Granby, Conn.; William M. Rowe, Jr., DeKalb, Miss.

[73] Assignee: Specialty Cable Corp., Wallingford, Conn.

[21] Appl. No.: 591,412

[22] Filed: Oct. 1, 1990

[51] Int. Cl.[5] ..... H05B 1/02; H05B 3/34

[52] U.S. Cl. ..... 219/549; 219/528; 219/212; 219/505

[58] Field of Search ..... 338/214, 210, 22 R; 219/549, 553, 504, 505, 548, 528, 544, 212, 529

[56] References Cited

U.S. PATENT DOCUMENTS

| | | |
|---|---|---|
| 2,820,085 | 1/1958 | Crowley . |
| 3,049,584 | 8/1962 | DiAscoli . |
| 3,155,631 | 11/1964 | Zapp, Jr. . |
| 3,474,189 | 10/1969 | Plate et al. . |
| 3,836,482 | 9/1974 | Ling et al. . |
| 4,008,367 | 2/1977 | Sünderhauf . |
| 4,143,238 | 3/1979 | Sheth . |
| 4,200,973 | 5/1980 | Farkas . |
| 4,314,145 | 2/1982 | Horsma . |
| 4,330,493 | 5/1982 | Miyamoto et al. . |
| 4,334,351 | 6/1982 | Sopory . |
| 4,436,986 | 3/1984 | Carlson . |
| 4,503,322 | 3/1985 | Kishimoto et al. . |
| 4,575,620 | 3/1986 | Ishii et al. . |
| 4,607,154 | 8/1986 | Mills . |
| 4,654,511 | 3/1987 | Horsma . |
| 4,661,690 | 4/1987 | Yamamoto et al. . |
| 4,689,601 | 8/1987 | Coffey et al. ..... 338/214 |
| 4,757,297 | 7/1988 | Frawley . |
| 4,910,391 | 3/1990 | Rowe . |

OTHER PUBLICATIONS

Union Carbide Polyethylene DHDA-7704 Black 55 Spec Sheet.

*Primary Examiner*—Bruce A. Reynolds
*Assistant Examiner*—Michael D. Switzer
*Attorney, Agent, or Firm*—St. Onge Steward Johnston & Reens

[57] ABSTRACT

A coaxial-type heater cable is described for significantly reducing both electromagnetic and electrostatic field while maintaining a flexible heater cable structure by enclosing coaxial arranged inner and outer conductors with a conductive polymer layer that is in electrical contract with the outer conductor. The outer conductor is helically wrapped around the inner conductor with the number of turns per unit length selected to significantly reduce the electromagnetic field emanating from the heater cable while the conductive polymer layer significantly attenuates any electrostatic field that would otherwise fringe through spaces between successive turns of the outer conductor. The heater cable can be of the self-regulating type using a PTC material in electrical contact with and between the inner and outer conductors.

1 Claim, 1 Drawing Sheet

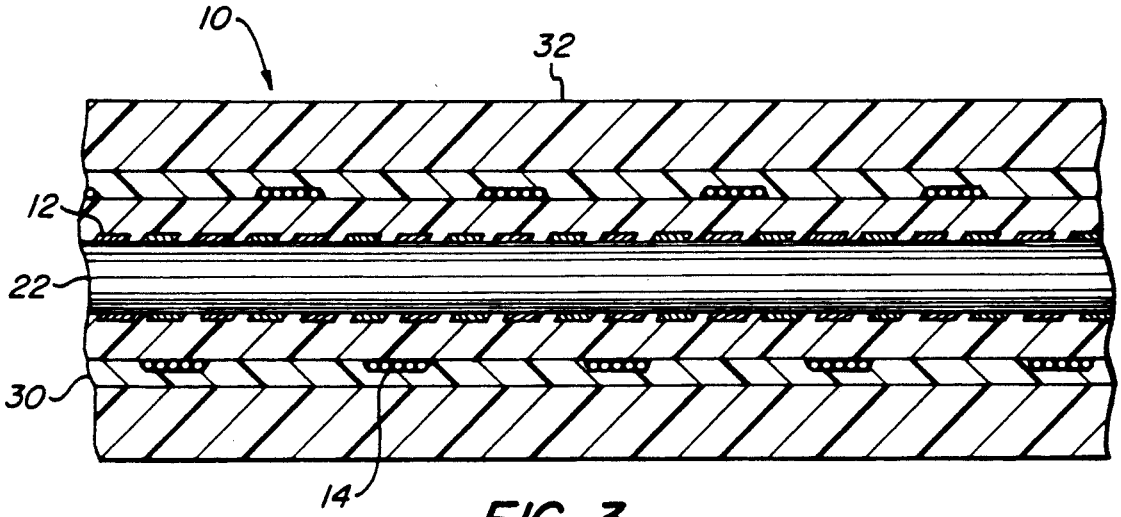
FIG. 3
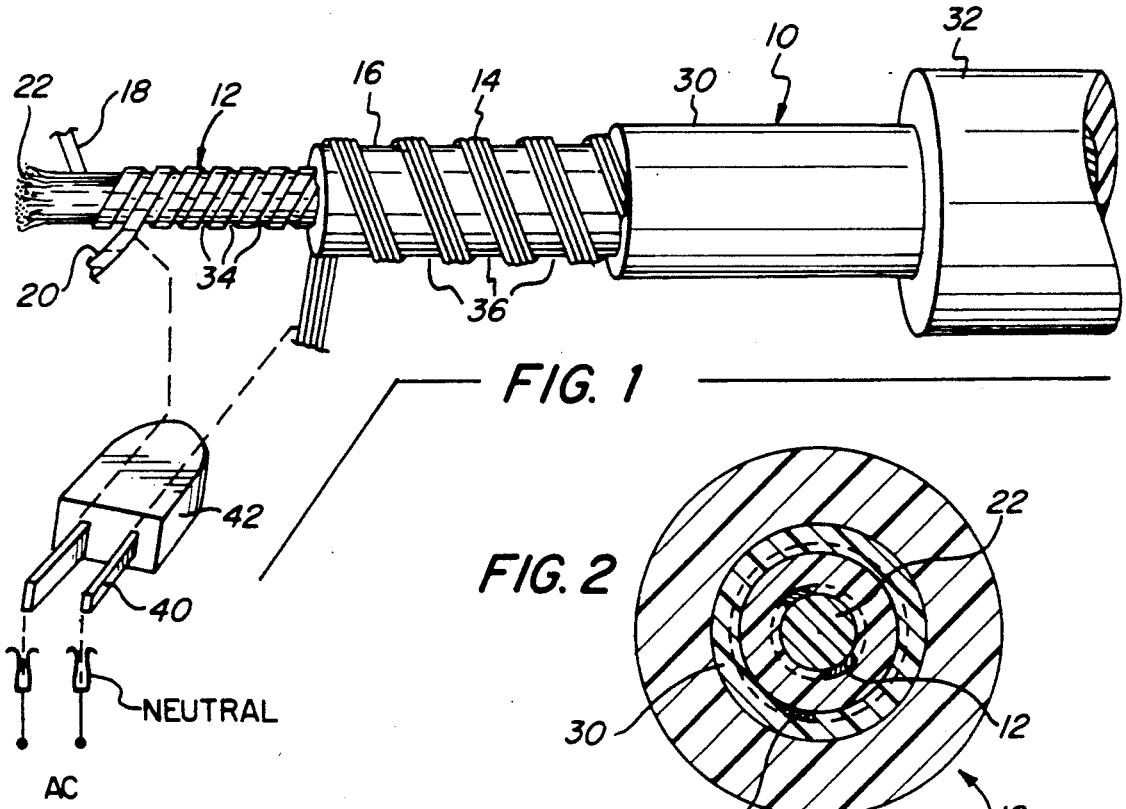
FIG. 1
FIG. 2
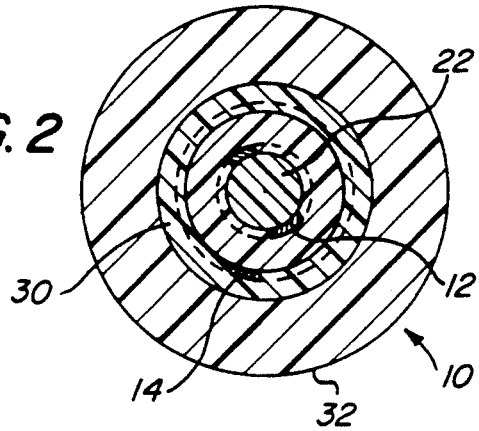

LOW ELECTROMAGNETIC AND ELECTROSTATIC FIELD RADIATING HEATER CABLE

FIELD OF THE INVENTION

This invention relates to heater cables for personal comfort products, such as electric blankets, heating pads and the like. More specifically, this invention relates to personal comfort heater cables radiating very low level electromagnetic and electrostatic fields.

BACKGROUND OF THE INVENTION

A personal comfort heater cable that practically does not radiate electromagnetic and electrostatic fields is described in U.S. Pat. No. 4,910,391 assigned to the same assignee as for this patent application. As described in one embodiment in this patent, a foil is wrapped around an insulator and a central conductor to reduce electromagnetic and electrostatic radiation.

Although a foil is effective in reducing such radiation, it is not always easy to handle and complicates the manufacture of the personal comfort heater cable.

Coaxial-type heater cables for personal comfort products have been described in the art. For example, in U.S. Pat. No. 4,661,690 to Yamamoto et al, helically-wrapped inner and outer conductors with an interposed PTC material are shown and described. Other coaxial heater wires are shown in U.S. Pat. Nos. 4,503,322 and 4,575,620.

U.S. Pat. No. 4,757,297 to Frawley shows an ignition cable in which a twisted central multiple conductor is enclosed by a semiconductor layer having sufficient resistance to dampen high frequency currents on the surface of the center conductor. An optional metal braid and insulator enclose the semiconductor layer and central conductor.

U.S. Pat. No. 4,143,238 to Sheth shows and describes a low voltage miniature cable containing one or a plurality of parallel insulated conductors that are surrounded by a semiconductor coating to provide a ground shield.

U.S. Pat. No. 4,008,367 shows and describes a power cable in which an outer metal shield encloses a plurality of inner layers, one of which is a conductive polymer layer. Another similar high voltage shielding construction is shown in U.S. Pat. No. 3,049,584.

U.S. Pat. No. 3,836,482 describes electric cables having semiconducting outer jackets in which drain wires are embedded (see also U.S. Pat. No. 3,474,189) to provide both shielding and mechanical protection.

Semiconductive shielding compounds are commercially available, such as Union Carbide's polyethylene DHDA-7704 Black 55. Such compound is intended to be extruded over strand and insulation shielding on thermoplastic insulated high voltage cables and over crosslinked polyethylen insulated high voltage cables.

SUMMARY OF THE INVENTION

With a personal comfort heater cable in accordance with the invention, both electromagnetic and electrostatic fields are substantially protected against. This is achieved with a coaxial heater cable construction wherein an inner conductor is enclosed by a helically-wound outer conductor with an extruded insulation layer or a positive temperature coefficient layer between the conductors. A flexible, strong continuous conductive polymer layer is extruded over the outer conductor. The number of turns per unit length of the outer conductor is selected commensurate with that needed to limit electromagnetic radiation to an acceptable level while the conductive polymer layer suppresses electrostatic radiation from the heater cable and strengthens the underlying small diameter heater cable.

The heater cable can use a resistive conductor to provide the heating energy or use an extruded positive temperature coefficient (PTC)of resistance layer between the inner and outer conductors. Both inner and outer conductors may be helically wrapped.

A particular advantage of a personal comfort heater cable in accordance with the invention is its flexibility and ability to withstand frequent flexing without breakage. Enhanced strength is obtained by selecting the conductive polymer so that it can form a bond with the PTC or insulative layer located between the inner and outer conductors. The conductive polymer layer is continuous so as to cover areas between the helical wraps of the outer conductor.

As described herein for a preferred form of a personal comfort PTC heater cable in accordance with the invention, a central conductor is helically wrapped around a core made of insulative fibers. A PTC polymer material is extruded over the central conductor and an outer conductor is helically wrapped with a predetermined number of turns per unit length around the PTC layer. A conductive polymer is extruded over the outer conductor and is in electrical contact therewith so that the outer conductor in effect short circuits the conductive polymer along the length of the heater cable.

With such heater cable the outer conductor prevents the escape of electromagnetic radiation and the conductive polymer, which bridges the regions between successive wraps of the outer conductor, prevents fringing of an electrostatic field between the wraps. The result is a coaxial type PTC heater cable exhibiting very low level radiation of both electromagnetic and electrostatic fields.

When an electric heater blanket is made with a heater cable in accordance with the invention, radiation of fields from the operation is reduced to safe levels, while using a heater cable design that is economic, has flexibility, and imparts mechanical protection to the underlying relatively thin outer conductor.

It is, therefore, an object of the invention to provide a heater cable for personal comfort devices that are safe to use and substantially free from electromagnetic and electrostatic radiation.

These and other objects and advantages of the invention can be understood from the following detailed description of a preferred embodiment described in conjunction with the drawings.

BRIEF DESCRIPTION OF DRAWINGS

FIG. 1 is a broken-away perspective side view in elevation of the heater cable of FIG. 2;

FIG. 2 is a crossectional view of a coaxial heater cable in accordance with the invention and is taken along a radial plane transverse to the axis; and FIG. 3 is a partial crossectional view of the heater cable shown in FIG. 1 and taken along its longitudinal axis.

DETAILED DESCRIPTION OF DRAWINGS

With reference to the Figures, a personal comfort heater cable 10 is shown greatly enlarged for clarity.

The heater cable 10 is of the coaxial type wherein a central inner conductor 12 is enclosed by an outer conductor 14 and the conductors separated by an intermediate layer 16.

The inner conductor 12 is formed of a pair of ribbon-shaped conductors 18, 20 that are electrically connected and helically wound in a bifilar manner around an insulative core 22. Core 22 is made of a plurality of fibers that can be made of dacron or nylon or other suitable material as is generally known in the art of manufacturing heater cables for personal comfort devices.

Intermediate layer 16 preferably is made of a positive temperature coefficient (PTC) of resistance material which is extruded over to enclose the inner conductor 12. The inner conductor is helically wrapped around the core 22 and the outer conductor 14 is helically wrapped around the intermediate layer 16. The outer conductor 14 is formed of a plurality of thin parallel strands.

A conductive polymer layer 30 is extruded over the outer conductor 14 and is in electrical contact therewith. The conductive polymer layer 30 is substantially at the same potential as outer conductor 14 which in effect short circuits the conductive layer 30. An insulative jacket 32 is extruded over conductive polymer layer 30.

The extrusion of intermediate layer 16 permeates spaces 34 (where these might occur) between successive wraps of inner conductor 12 and is in electrical contact with this conductor. The conductive polymer layer 30 permeates spaces 36 between successive wraps of outer conductor 14 and is in electrical contact with both PTC intermediate layer 16 and conductor 14.

The intermediate layer 16 preferably is formed of a polymeric composition using a low density polyethylene, a carbon black, and a suitable copolymer. The specific composition of the PTC material can be varied and reference can be made to many such compositions as described in the art. Generally, the PTC material has a volume resistivity that is less than about 1,000 ohm-cm, with a typical resistivity being of the order of about 400 to 500 ohm-cm at room temperature of about 20° C. When the heater cable temperature increases, the resistivity of layer 16 also increases, generally two to five orders of magnitude over a temperature change of about 100° C.

The conductive polymer layer 30 is preferably formed of a stable conductive polymeric material whose conductivity remains high as temperature increases. Typically, the volume resistivity is as low as is practical with volume resistivities in the range of generally less than about 155 ohm-cm, particularly less than about 100 ohm-cm at an ambient temperature of 20° C. and preferably less than about 20 ohm-cm.

One material found suitable to form conductive polymer layer 30 is a Union Carbide semi-conductive thermoplastic polyethylene compound DHDA-7704 Black 55. This material has a DC volume resistivity of fifteen (15) ohm-cm at 23° C. and 500 ohm-cm at 90° C.

When a very low resistivity polyethylene compound such as DHDA is extruded over a coaxial arrangement as shown in the Figures with a low-density polyethylene PTC layer 16, a bond between these layers can be established at the interstices 36 between successive wraps of the outer conductor 14. A bond enhances the mechanical strength of the heater cable 10. The thickness of conductive polymer layer 30 is very thin, approximately five thousandths of an inch.

Coaxial heater cables 10 were made as described using the DHDA-7704 compound for layer 30 and different wraps per unit length for outer conductor 14. Tests were then made to measure both EMR (electromagnetic radiation) and ESR (electrostatic radiation). These tests were also made for comparison purposes of different cables, i.e., without a conductive layer 30. These tests were made at a distance of two inches above a bed of serpentine pattern wires and using a high internal impedance Fluke meter. The results of these measurements are listed below.

TABLE I

| Outer Conductor 14 (Turns/Inch) | Conductive Layer 30 | ESR Field (Volts) | EMR Field (milli-gauss) |
|---|---|---|---|
| 4 | None | 5.0 | .03 |
| 4 | Present | 1.65 | .06 |
| 18 | None | 2.16 | .018 |
| 18 | Present | 1.85 | .032 |
| Standard retail electric blanket using PTC material in a dogbone construction | None | 26.5 | 5.75 |

The measurements of Table I are after subtraction of background measurements of 0.01 volts (ESR) and about 0.063 mg (EMR). The differences between 0.018 and 0.06 mg and between 1.65 and 2.16 volts are insignificant and within measurement errors.

The results in Table I show that the EMR field is very low whether the outer conductor 14 has four or 18 turns per inch. However, the wider spacing of a 4 TPI outer conductor 14 allows more fringing by an ESR field, and this is substantially reduced by the presence of conductive polymer layer 30 over the 4 TPI outer conductor 14.

Hence, by using the conductive layer 30, fewer turns of conductor 14 can be safely used exhibiting low ESR generally less than five and particularly less than three volts and EMR fields while saving substantially in the amount of material needed for outer conductor 14. The number of turns per unit length of outer conductor 14 can be reduced to a level sufficient to retain EMR shielding without excessive ESR fringing. Generally, the number of turns per inch is substantially less than about 18, preferably less than about ten and as shown in Table 1 can be as low as four and probably even lower. Although the outer conductive layer 30 preferably is extruded over conductor 14, layer 30 can be formed by other processes such as a slurry technique.

In order to achieve the best possible operation of a heater cable 10 in accordance with the invention, it is preferred that the outer wrapped conductor 14 is connected to the neutral terminal 40 of a standard polarized AC line plug 42.

Having thus described a preferred form of the invention, variations can be made without departing from the scope of the invention.

For example, instead of a PTC intermediate layer 16, an insulative polymer layer 16 can be used. In such case at least the inner conductor 12 is formed of a resistance element capable of delivering a desired amount of heat per unit length. The term conductor as used herein thus encompasses heat generating resistive conductors as are well known in the art.

What is claimed is:

1. A low electromagnetic field and low electrostatic field radiating AC-powered heater cable for a personal comfort product such as an electric blanket and the like, comprising:

an inner conductor;

a flexible continuous, intermediate polymer layer enclosing the inner conductor;

an outer conductor helically wrapped around the intermediate layer with a predetermined number of turns per unit length;

a conductive polymer layer having a desired low resistivity and which extends around the outer conductor and in electrical contact therewith and covering regions between successive turns of the outer conductor;

wherein the conductive polymer layer and the number of turns per unit length of the outer conductor are selected to inhibit the radiation of electromagnetic and electrostatic fields from the heater cable, with the number of turns per unit length of the outer conductor being sufficiently high and the resistivity of the conductive polymer being sufficiently low to limit the ESR field to a level of less than about three volts and the EMR field to generally less than about a fraction of a milligauss; and an insulative jacket enclosing the conductors and conductive polymer layer.

* * * * *